US005199235A

United States Patent [19]

Holkenbrink et al.

[11] Patent Number: 5,199,235

[45] Date of Patent: Apr. 6, 1993

[54] CLEAN ROOM WALL SYSTEM

[75] Inventors: Michael H. Holkenbrink; David G. Madden, both of Mesa, Ariz.

[73] Assignee: Motorola, Inc., Schaumburg, Ill.

[21] Appl. No.: 569,301

[22] Filed: Aug. 20, 1990

[51] Int. Cl.[5] ..... E04B 2/74; E06B 1/04

[52] U.S. Cl. ..... 52/211; 52/205; 52/207; 52/213; 52/282; 52/238.1; 52/745.15

[58] Field of Search ..... 52/213, 215, 208, 210, 52/211, 212, 204, 238.1, 282, 205, 206, 207, 741

[56] References Cited

U.S. PATENT DOCUMENTS

| | | | |
|---|---|---|---|
| 3,299,592 | 1/1967 | Cable | 52/215 |
| 4,259,818 | 4/1981 | Stark | 52/208 |
| 5,010,702 | 4/1991 | Daw et al. | 52/241 |

*Primary Examiner*—Michael Safavi
*Attorney, Agent, or Firm*—Joe E. Barbee

[57] ABSTRACT

An improved panel wall system uses modified battens to simplify the installation of doors, windows, and accessories. An improved mounting system for windows provides flexibility of size and location, while providing for a substantially planar clean room surface. The mounting system used for windows can be adapted directly for mounting any flat accessory, or any accessory mounted upon a flat frame. An improved door jamb element allows the use of butt hinges to hang a door panel, while providing structural support. The improved door jamb element also provides for the on-site addition of a door to an existing panel wall system. An improved mounting system for a transom above a door panel simplifies on-site installation of the transom.

4 Claims, 6 Drawing Sheets

-PRIOR ART-

-PRIOR ART-

-PRIOR ART-

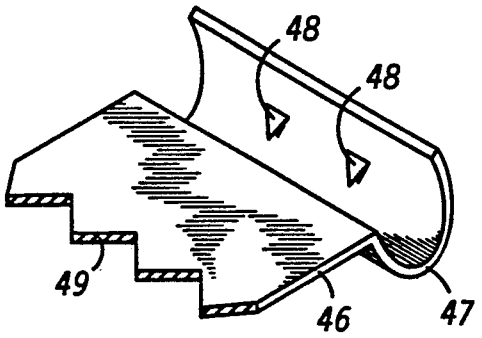
FIG. 5
FIG. 6
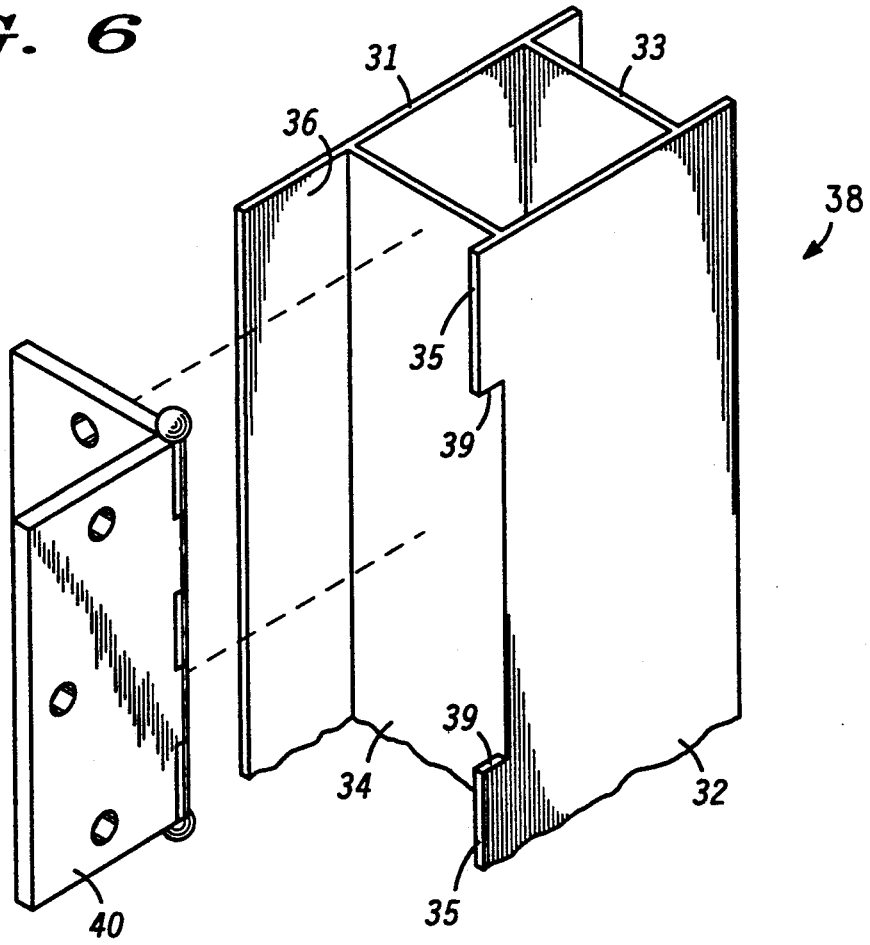

CLEAN ROOM WALL SYSTEM

BACKGROUND OF THE INVENTION

The present invention relates, in general, to panel wall systems, and more particularly to a system providing for flexibility in the installation of doors, windows, and accessories in the panel wall system, while maintaining the integrity of a clean room environment.

Panel wall systems are quite widely used in a variety of applications. Normally they are used as space dividers inside a larger structure. Applications include such diverse arenas as office dividers and semiconductor device fabrication clean rooms. It is this latter application, wherein the density of particulates in the atmosphere is strictly controlled, to which the present invention applies directly. The invention, however, can be easily adapted to other areas.

A typical wall panel system for a clean room is made with multiple wall sections. The sections are mounted in tracks affixed to the ceiling and floor of the building, and connected together by a system of battens. A front batten, normally relatively smooth, is placed on the front side (or inside) of the panels along the joint between two panels. The back of the front batten has two parallel flanges running the length of the batten. The flanges are spaced closely so that a screw will fit tightly between them. The flanges are then grooved such that the ridges act somewhat like the threads of a nut, enabling the front batten to hold a screw securely. A rear batten is then placed along the joint on the back side (or outside) of the panels. Screws are passed through holes in the rear batten and into the flanges on the back of the front batten, then tightened so as to hold the two panel sections together securely. In this way an entire system of walls can be built. Passage through the walls thus built is through door panels mounted between wall panels. Special factory-built door jamb assemblies allow interface with the standard front and rear battens. A transom is mounted above the door, filling the space left between wall panels above the door.

In the past, the installation of windows, doors, and other accessories introduced numerous ledges and other complex surfaces which could act as collectors of particulate matter. This tended to compromise the integrity of the clean room to an extent. For example, doors were mounted on pivot hinges which extended slightly into the room. The bottom plate of the pivot hinge could collect dust and interfere with clean room housekeeping. The use of butt hinges had the disadvantage that the weight of the door was supported only by the screws which held the hinges. The screws thus tended to pull out of the door jamb.

Windows of a fixed size were mounted into wall panels at the factory. A window installation that could be modified on site was introduced, but required the use of numerous fittings to frame the window. The frame was held in place by the same battens as used by the wall panels. The design of the frame created a ledge inside the clean room which could collect particulates. The installation process itself was complicated by the need to hold the front battens in place while affixing the rear battens, requiring two or more people to mount a window frame assembly.

The inflexibility of the system became apparent when it became necessary to make changes to the panel wall installation, or to add accessories to the clean room. Smaller accessories, such as a clean room telephone, were difficult to adapt to the panel wall system at all. Larger accessories, such as etchers, implanters, etc., that have openings located in the clean room, but are located substantially within maintenance bays, presented a particular challenge, requiring expensive precise manufacturing of custom wall panels.

SUMMARY OF THE INVENTION

The objects and advantages of the present invention are to provide a panel wall system for a clean room environment which allows the installation of doors and accessories in such a manner as to maintain substantially planar surfaces, reducing accumulations of particulates. A method of installing accessories is provided which allows for flexibility of the size of the opening in which the accessory is installed, and provides for superior bulkheading of large pieces of equipment, such as etchers, implanters, etc. Further, an improved door panel installation is provided which gives support to the door while eliminating the dust collection associated with pivot hinges. A method of installing a transom above a door is also provided, which substantially reduces the on-site modifications necessary to accomplish the installation. The entire assembly operation is greatly simplified by a retaining clip which holds connecting battens in place during assembly.

BRIEF DESCRIPTION OF THE DRAWINGS

FIG. 5 illustrates a retaining clip;

FIG. 6 illustrates a section of an improved door jamb element;

DETAILED DESCRIPTION OF THE DRAWINGS

Figure 1:
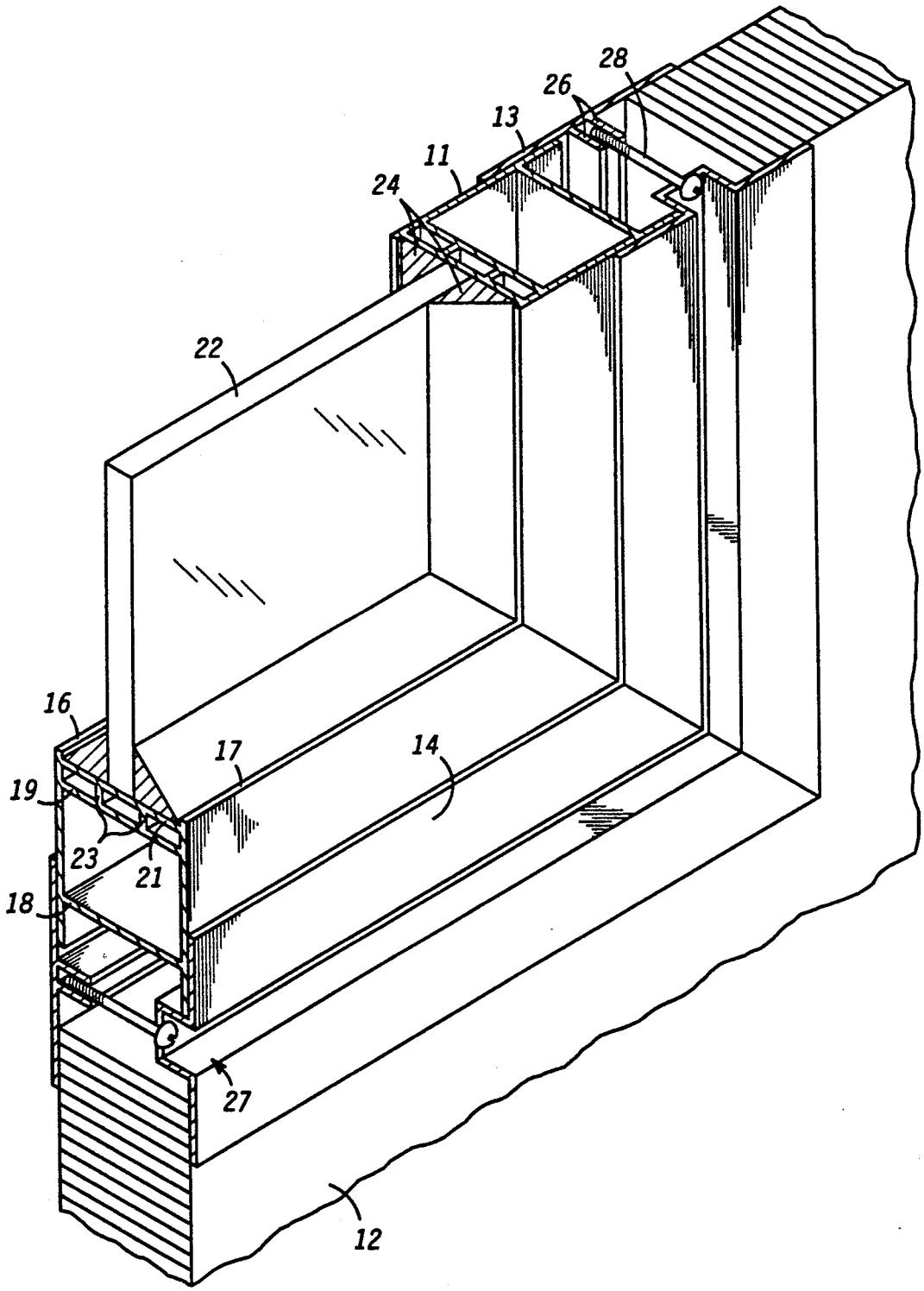
FIG. 1 is illustrates a prior art window installation.
Figure 2:
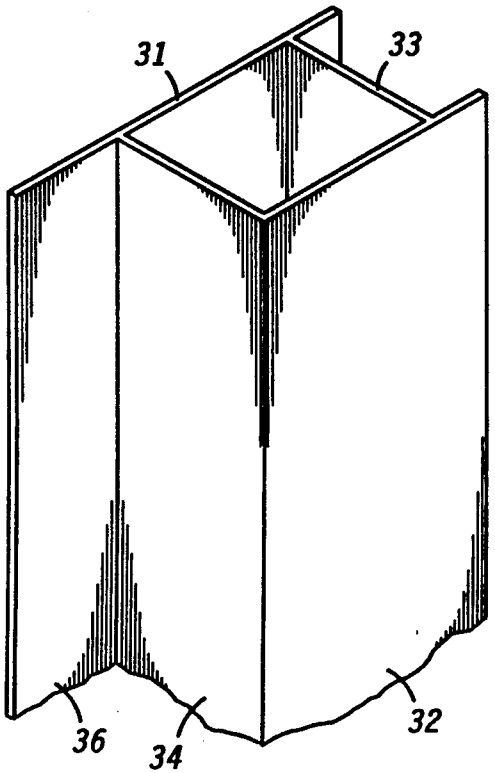
FIG. 2 illustrates a section of a prior art door jamb element.
Figure 3:
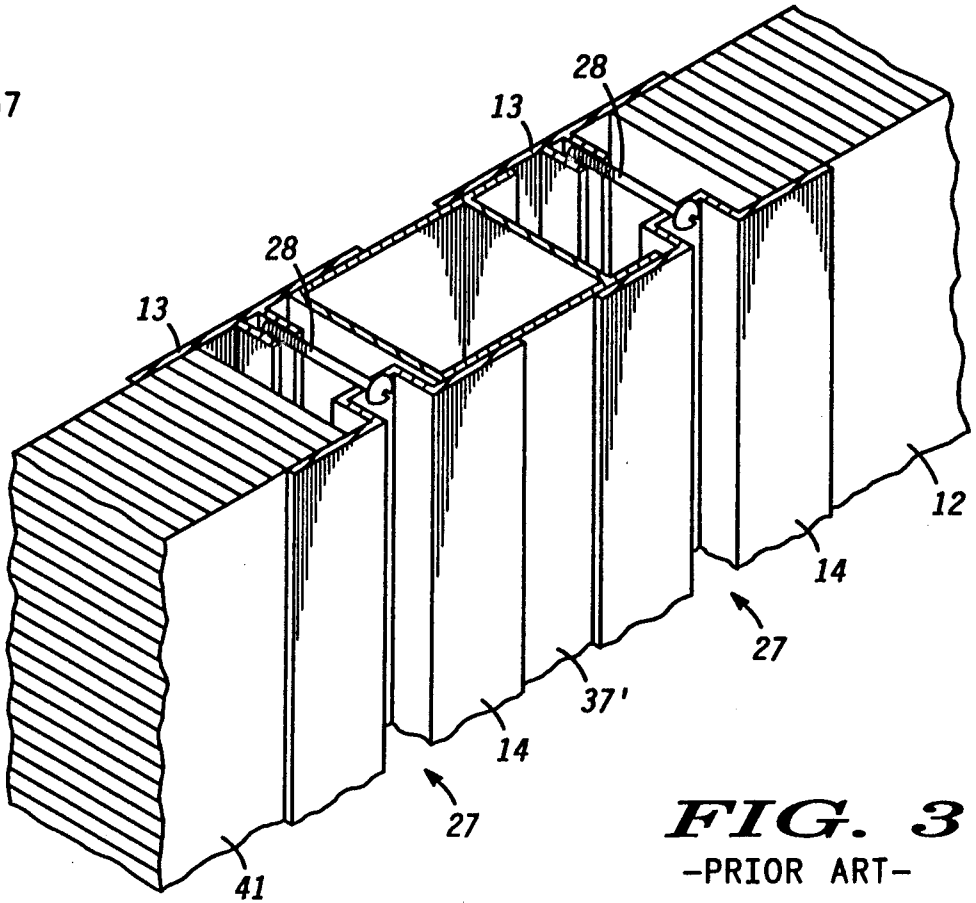
FIG. 3 illustrates a prior art transom assembly.

The discussion of the present invention begins with a review of the prior art, illustrated in FIG. 1, FIG. 2, and FIG. 3. FIG. 1 is a cross sectional view of the prior art window installation. Window 22 is mounted in window frame 11. Window frame 11 is a single elongated aluminum extrusion, having two flat parallel sides 16 and 17 connected by lateral members 18, 19, and 21. Lateral member 18 is inset slightly from the outer edges of sides 16 and 17, the outer edge being that edge away from window 22. Lateral members 19 and 21 are closely spaced to one another and are connected together by support members 23. Lateral members 19 and 21, in order to provide strength to support window 22, are inset slightly from the inner edge of window frame 11, the inner edge being that edge toward window 22. Window 22 thus abuts lateral member 21. Window 22 is centered between sides 16 and 17, and held in position by retainers 24, retainers 24 being fashioned to fit tightly between side 16, lateral member 21, and window 22 on one side of window 22, and also to fit tightly between side 17, lateral member 21, and window 22 on the other side of window 22. All battens are mitered as necessary at window corners.

The assembly comprising window 22 and window frame 11 is coupled to wall panel 12 by means of front batten 13 and rear batten 14. Front batten 13 is a single elongated aluminum extrusion with one flat side, the flat side being designated as the front side. The back side of front batten 13 is also flat except for two closely spaced flanges 26 in the center of front batten 13, running the length of front batten 13. The facing edges of flanges 26 are grooved such that flanges 26 will grip tightly to the threads of a screw. Rear batten 14 is a single elongated aluminum extrusion with the same lateral dimension of front batten 13, being essentially flat, except that a recess 27 is formed in the center of rear batten 14, running the length of rear batten 14. A number of holes are made through rear batten 14 in the center of recess 27 through which a number of screws, represented in FIG. 1 by screw 28, may be passed. Screw 28 is then tightened into grooved parallel flanges 26 of front batten 13. The assembly comprising front batten 13 and rear batten 14 coupled by screw 28 forms a clamp with two edges. The first edge clamps over an edge of wall panel 12, while the second edge clamps over the outer edge of window frame 11 when screw 28 is securely tightened. Recess 27 may then be covered by a self-retaining capping strip (not illustrated).

FIG. 2 is an illustration of a section of a prior art door jamb element. The door jamb element is a single elongated aluminum extrusion, having front side 31 in parallel with back side 32 coupled by lateral members 33 and 34. Lateral member 33 is connected perpendicularly to front side 31 and to back side 32, and is inset slightly from one edge of sides 31 and 32. This edge is designated the outer edge. Front side 31 and back side 32 align evenly along the outer edge. Lateral member 34, in parallel with lateral member 33, couples perpendicularly to back side 32 even with the inner edge of back side 32, and to front side 31. Front side 31 is wider than back side 32, creating relatively wide lip 36, which therefore extends inward from the inner edge of the door jamb element, serving as a door stop against which a door can rest in a closed position. The door jamb element is coupled to a vertical edge of a wall panel of the panel wall system by battens identical to front batten 13 and rear batten 14 of FIG. 1. The door jamb element runs the entire length of the wall panel from floor to ceiling, and is anchored to the floor and to the ceiling to provide structural strength. To form a door jamb, a second door jam is coupled to another wall panel installed an appropriate distance from the first door jamb element. The top of the door jamb is defined by coupling a third length of door jamb element horizontally between the two vertical door jamb elements. The space above the horizontal door jamb element is filled by a transom 41, mounted as illustrated in FIG. 3. FIG. 3 is a top cross-sectional view through door jamb element 37, taken above the door opening. The cross-sectional view includes a portion of wall panel 12 and transom 41 located above the door. The outside edge of vertical door jamb element 37' is coupled to wall panel 12 by means of front batten 13, rear batten 14, and screw 28 as in FIG. 1. Wide lip 36 is machined off of door jamb element 37 along the section of door jamb element 37 where transom 41 is to be installed, creating door jamb element 37'. This allows transom 41 to be coupled to the inner edge of door jamb element 37' using front batten 13, rear batten 14, and screw 28. The bottom side of transom 41 is coupled to the horizontal third length of door jamb element using front batten 13, rear batten 14 and screw 28 as in FIG. 1.

The prior art has a number of problems and limitations. The window assembly is complex, consisting of several different elements. The window frame itself is a rather substantial element, contributing significantly to the cost of the system. Furthermore, the method of mounting the window in the frame leaves a relatively large lip which will collect particulates, impinging upon the integrity of the clean room. Additionally, the means for installing a window as described does not lend itself to adaptation for installation of other accessories, such as a clean room telephone. Also, it takes at least two people to install the window, because the front batten must be held in place until the rear batten is attached.

The door jamb does not provide proper support for a door when hung on butt hinges. The screws used to mount the butt hinges to the inner edge of the door jamb element would tend to pull out of the aluminum, leading to structural failure. One solution was the use of top and bottom pivot hinges, which allow the weight of a door to rest upon a cleat mounted on the floor. However, the cleat will act as a collector of particulates, once again negatively impacting the integrity of the clean room. Pivots also resulted in door alignment problems, as the top pivot was difficult to align to the bottom pivot. Finally, the transom installation requires extensive machining of the door jamb elements at the installation site, increasing the difficulty of the installation process and increasing the amount of residual particulates in the clean room site.

Figure 4:
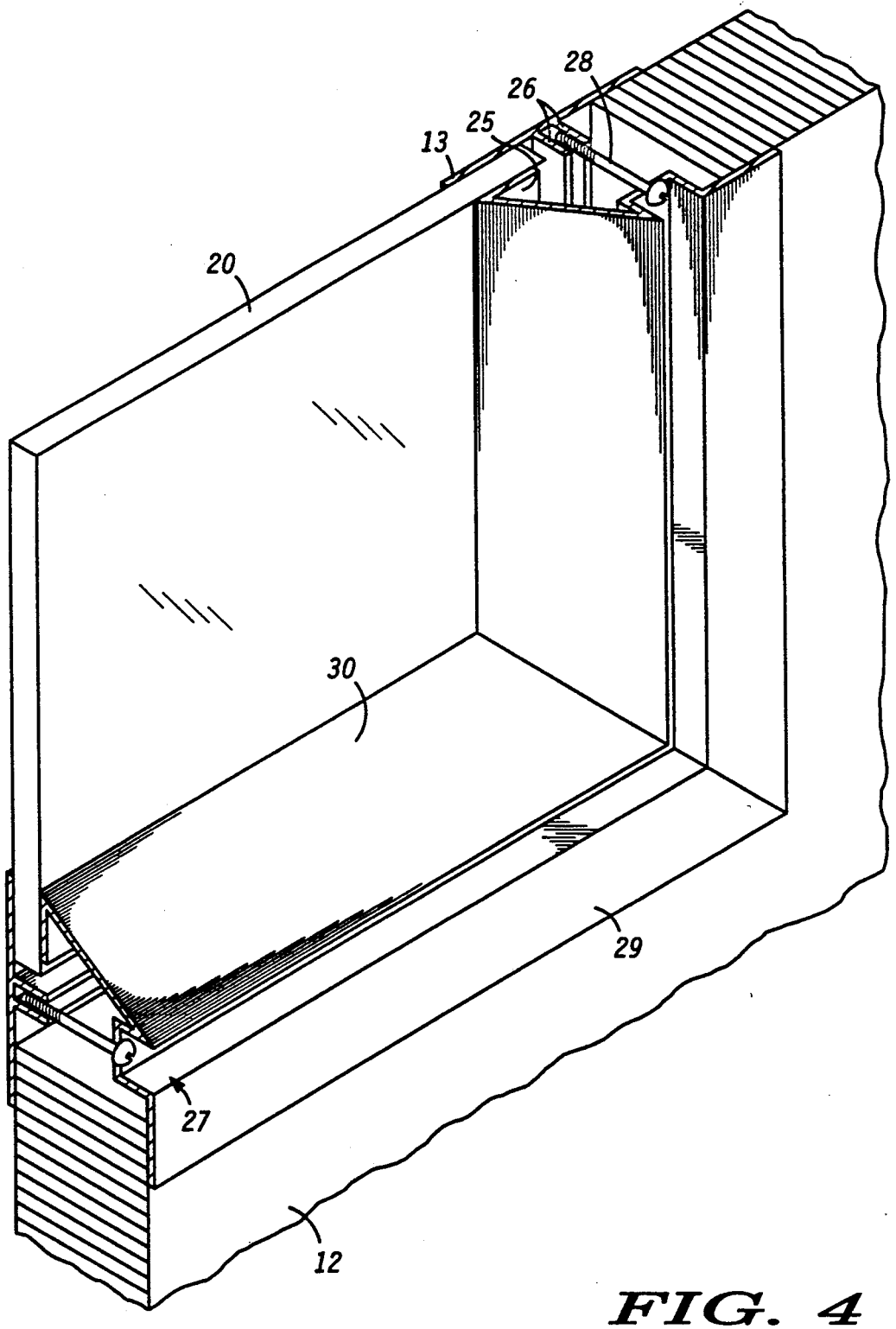
FIG. 4 illustrates an improved accessory installation.

The present invention addresses each of these limitations. FIG. 4 illustrates an improved means for installing a window, which means can be easily adapted for the installation of other accessories. Window frame 11 has been eliminated, and with it, retainers 24. Rear batten 14 is replaced by a new rear batten 29. Front batten 13 is held in place prior to the installation of rear batten 29 by a clip 46, illustrated in FIG. 5. Clip 46 is made of a spring-like material which is of appropriate length to reach from the center of the back side of front batten 13 to wall panel 12. One end of clip 46 is bent into "U" shape 47, while the other end, being flat, extends at an obtuse angle from the top of "U" 47. The flat end of clip 46 is provided with a serrated edge 49. Since wall panel 12 is made of metal or plastic skins interspaced with an interior honeycomb, a hole is easily made in the honeycomb using serrated edge 49 such that the flat end of clip 46 can be pushed into wall panel 12. The flat end of clip 46 will then rest against the inside of the skin that makes up the outer surface of wall panel 12. Cuts are made in "U" 47 near the end of clip 46 such that triangular tabs 48 can be bent inward toward the inside of "U" 47 The points of tabs 48 point toward the bottom, or bend, of "U" 47. The end of clip 46 with "U" 47 and tabs 48 is pushed into the space between parallel flanges 26 of front batten 13. Tabs 48 catch in the threaded grooves provided in flanges 26, thus holding front batten 13 in place.

As shown in FIG. 4, window or accessory 20 is placed directly against the back side of front batten 13. Rear batten 29 is a single elongated aluminum extrusion with recess 27 running the length of rear batten 29. Recess 27 is identical to recess 27 of rear batten 14. Screws represented by screw 28 couple rear batten 29 to front batten 13. To one side of recess 27, rear batten 29 is identical to rear batten 14. This side of rear batten 29, together with front batten 13, forms a clamp for wall panel 12 in the same manner as does rear batten 14 in FIG. 1. On the other side of recess 27, however, rear batten 29 is significantly different from rear batten 14. From the edge of recess 27, rear batten 29 bends at an acute angle forming a sloped portion 30, such that the edge of rear batten 29 reaches forward to press against window or accessory 20. Sloped portion 30 facilitates air flow and provides no flat shelf to collect dirt or miscellaneous objects. At the point where rear batten 29 reaches window or accessory 20, the edge of rear batten 29 is bent under in order to provide a flat surface 25 to press against window or accessory 20. When screw 28 is tightened, window or accessory 20 and wall panel 12 are securely clamped between front batten 13 and rear batten 29. Seals may be placed between front batten 13 and wall panel 12, and between front batten 13 and window or accessory 20 to provide a barrier to the leakage of air through the wall panel assembly. Pads may be placed between rear batten 29 and window or accessory 20, as appropriate, to protect window or accessory 20 from stress.

A unique feature of the above embodiment is that window or accessory 20 can be any flat object, including any object mounted on a flat frame. It then becomes possible to mount a wide variety of accessories through a wall panel. One such accessory could be a clean room telephone. Another could be a means for sealing around large pieces of equipment such as an etcher or implanter. An opening can be made in a wall panel which would fit around the equipment, and then the space between the opening and the equipment filled by a means for sealing, the means for sealing being coupled to the wall panel in the same manner described for window or accessory 20 herein.

Figure 8:
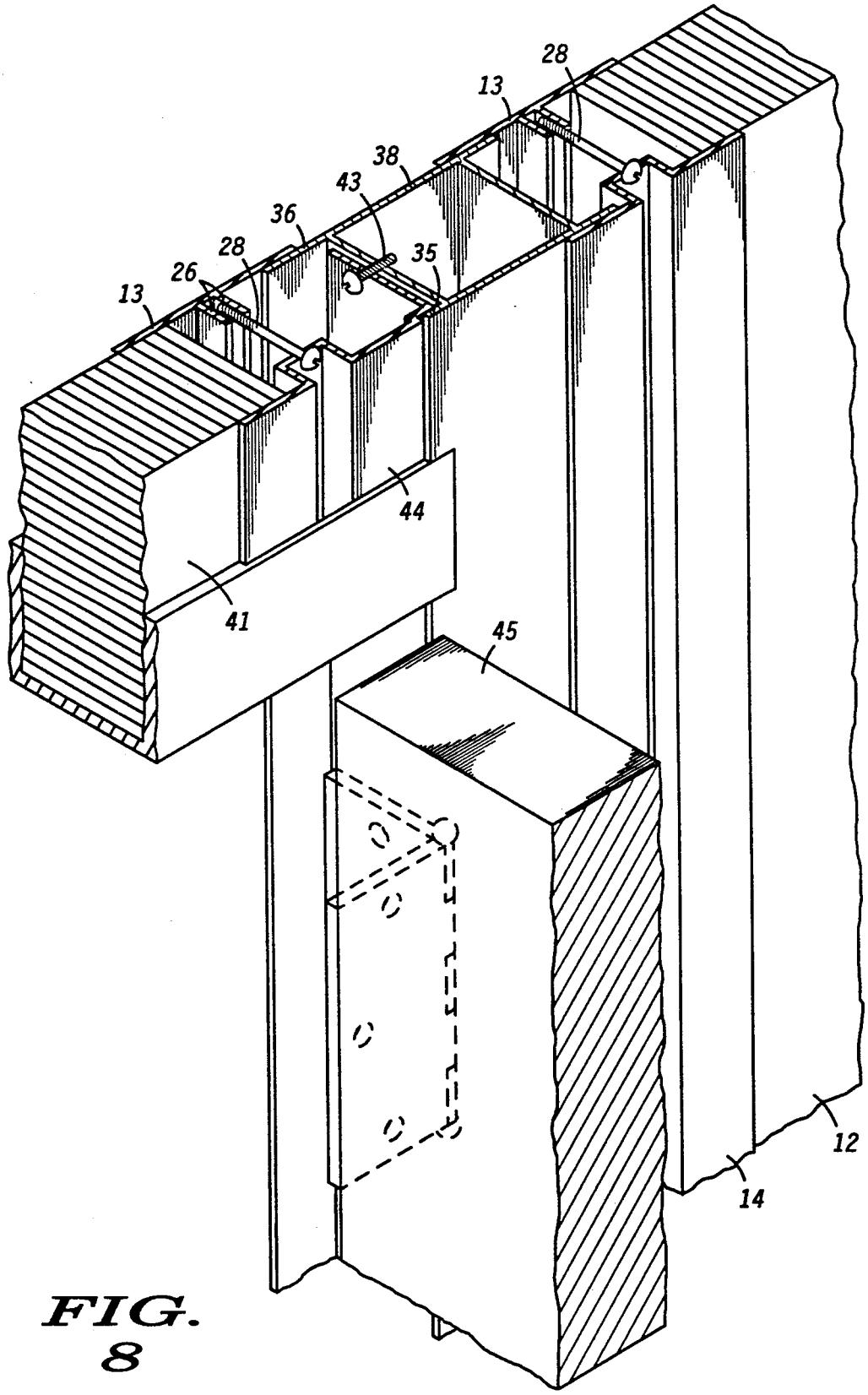
FIG. 8 illustrates the assembly of a door panel, butt hinge, wall, and transom.

FIG. 6. illustrates a section of an improved door jamb element for the panel wall system. Improved door jamb element 38 directly replaces door jamb element 37. Most of the details of door jamb element 38 are similar to door jamb element 37. The major difference is that back side 32 has been extended slightly beyond lateral member 34 to form narrow lip 35. To allow a butt hinge to be mounted to door jamb element 38, notch 39 is machined into narrow lip 35. A butt hinge 40 is then coupled to the face of lateral member 34 such that butt hinge 40 protrudes through notch 39. The majority of the weight of a door 45 (see FIG. 8) coupled to butt hinge 40 is thus borne by narrow lip 35. This eliminates the need for a pivot hinge and its associated limitations.

Figure 7:
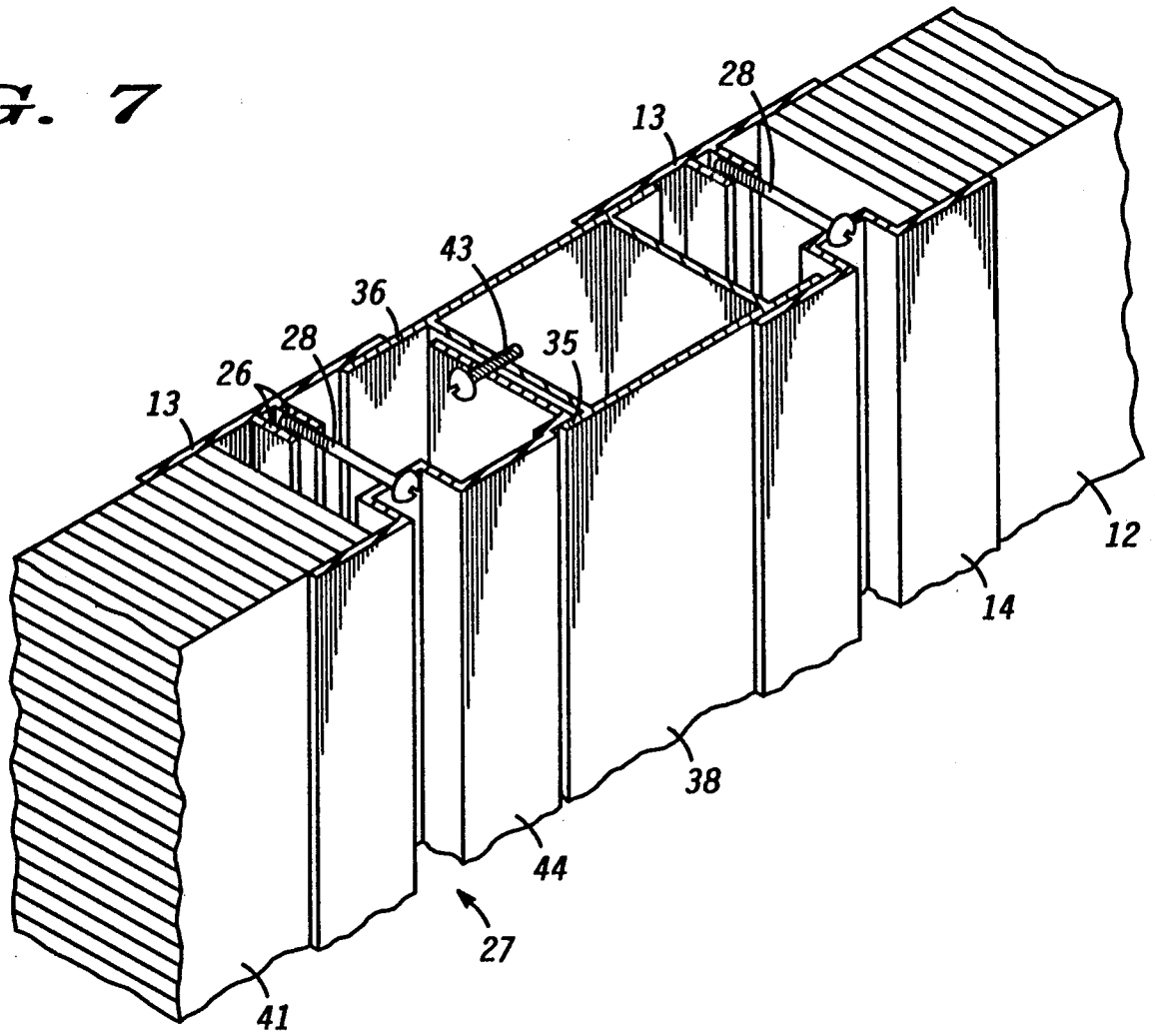
FIG. 7 illustrates an improved transom assembly.

FIG. 7. illustrates an improved transom installation. Vertical door jamb element 38 of FIG. 6 is coupled to wall panel 12 by means of a first front batten 13, rear batten 14 and screw 28 as in FIG. 1. In this installation, wide lip 36 is not machined off as in FIG. 3. A second front batten 13 is placed so as to rest against one side of transom 41 and against wide lip 36. Rear batten 14 is replaced by rear batten 44. Rear batten 44 is similar to rear batten 14 and rear batten 29 in that rear batten 44 has a recess 27 which contains holes through which screws represented by screw 28 are passed and tightened into front batten 13. To one side of recess 27, rear batten 44 is identical to rear batten 14 and rear batten 29, forming a clamp in conjunction with front batten 13 and screw 28 to securely hold one end of transom 41. On the other side of recess 27, rear batten 44 extends from the edge of recess 27 to narrow lip 35 of door jamb element 38. From there, rear batten 44 is formed such that rear batten 44 rests flat against lateral member 34 of door jamb element 38, extending across lateral member 34 from narrow lip 35 to wide lip 36. Rear batten 44 is then coupled to door jamb element 38 by passing screws, represented by screw 43, through rear batten 44 and into lateral member 34. By eliminating the necessity of machining off wide lip 36, the installation of the transom is greatly simplified.

By now it should be appreciated that there has been provided an improved panel wall system for a clean room environment. The present invention provides for substantially planar surfaces, reducing the propensity of doors, windows, and accessories to collect particulates. Installation of the present invention is simplified, with fewer custom panels being made at the factory, while on-site modifications to individual elements of the system are reduced. By the use of retaining clip 46, the panel wall system can be easily assembled using less man power. Also, the installation of windows and accessories is accomplished through the use of two parts, 13 and 29, as opposed to the five parts, 11, 13, 14, and 24 (two pieces), previously required, reducing the overall expense of the installation.

We claim:

1. A panel wall system for a clean room environment having at least one substantially planar surface which deters the accumulation of particulates, comprising:

a plurality of flat wall panels, having a first side and a second side, being interconnected by battens, providing a substantially planar surface for the clean room panel wall system on at least the first side;

at least one opening through one of the plurality of wall panels for mounting an accessory in the panel wall system;

means for joining the accessory to the wall panel, which means maintains the substantially planar surface of the first side;

at least one door panel, allowing passage through the panel wall system, the door panel having a first edge and a second edge;

means for hinging the door panel to the panel wall system, which means maintains the substantially planar surface of the first side;

at least one transom, having a first side and a second side, the first side facing the same direction as the substantially planar surface; and means for mounting the transom above the door panel, which means maintains the substantially planar surface of the first side, wherein the means for hinging the door panel to the panel wall system comprises a door jamb element, having a front side, a back side, an outer edge, and an inner edge, the outer edge being formed such that the outer edge can be coupled to a wall panel using battens, the front side and back side being formed such that when the outer edge is coupled to the wall panel, the front side aligns with the first side of the wall panel in a substantially planar fashion, and the back side aligns with the second side of the wall panel in a substantially planar fashion, the front side further being formed such that the inner edge of the front side extends laterally in such a fashion as to form a wide lip against which the door panel rests when in a closed position, the back side further being formed such that the inner edge of the back side extends laterally in such a fashion as to form a narrow lip, a space existing between the wide lip and the narrow lip corresponding to the width of the door jamb element, at least one notch being machined in the narrow lip to accept a butt hinge, the butt hinge being coupled to the first edge of the door panel, the butt hinge further being coupled to the door jamb element in such a fashion that the narrow lip bears the weight of the butt hinge and of the door panel.

2. A panel wall system according to claim 1 wherein the means for mounting the transom above the door panel comprises:

a front batten having a front side, a back side, a first edge and a second edge, the front side being substantially planar, the back side having means to accept a screw, the front batten being placed such that the back side of the first edge of the front batten rests against the front side of the door jamb element, and the back side of the second edge of the front batten rests against the first side of the transom;

a rear batten having two edges running the length of the batten, the first edge forming a lip which is placed against the second side of the transom, the batten then having a recess adjacent to the lip, running the length of the batten, which defines the width of the lip, and having at least one hole for accepting a first screw, the first screw being passed through the hole to couple the rear batten to the front batten, the rear batten further extending from the recess to a point adjacent to the narrow lip of the back side of the door jamb element, and thence from the narrow lip across the inner edge of the door jamb element to the wide lip of the front side of the door jamb element, the rear batten being formed such that the second edge of the rear batten fits tightly in the space between the wide lip and the narrow lip, the second edge having at least one hole for accepting a second screw by which the rear batten is coupled to the inner edge of the door jamb element, the transom thus being held fixedly between the front batten and the rear batten when the rear batten is coupled to the front batten by means of the first screw.

3. A door assembly for a panel wall system comprising:

a door panel, having a first edge and a second edge;

at least one butt hinge, the butt hinge being coupled to the first edge of the door panel;

a transom;

a door jamb element, having a front side, a back side, an outer edge, and an inner edge, the outer edge being formed so as to provide for coupling to the panel wall system using battens, the inner edge being formed such that the front side extends laterally, forming a wide lip against which the door panel rests when in a closed position, and the back side extends laterally, forming a narrow lip, a space existing between the wide lip and the narrow lip corresponding to the width of the door jamb element, the narrow lip being machined to accept the butt hinge, the butt hinge being coupled to the door jamb element in such a fashion that the narrow lip bears the weight of the butt hinge and of the door panel; and means for coupling the transom to the door jamb element above the door, wherein a rear batten is coupled to the inner edge of the door jamb element, and a front batten is coupled to the rear batten, the front batten having a front side and a back side, the back side having means to accept a first screw, the front batten being placed such that the back side of the front batten rests against the front side of the door jamb element, further resting against the wide lip, the rear batten having two edges running the length of the batten, the first edge being placed against the inner edge of the door jamb element adjacent to the wide lip, the rear batten then extending across the inner edge of the door jamb element to the narrow lip, at least one hole for accepting a second screw being formed in the rear batten, the second screw then passing through the hole and into the inner edge of the door jamb element, thus coupling the rear batten to the door jamb element, the rear batten further extending at an angle parallel to the front batten thereby creating a space between the front batten and the rear batten into which an edge of the transom is inserted, there further being a recess in the rear batten which limits the depth to which the transom can be inserted, the recess having at least one hole through which the first screw is inserted and tightened into the means for accepting the first screw, thereby coupling the front batten to the rear batten in such a manner as to fixedly hold the transom.

4. A method for mounting a door between two sections of a clean room panel wall assembly while maintaining a substantially planar wall surface, comprising:

securing a door jamb element to each of the two sections, the door jamb element having a narrow lip;

providing the narrow lip so as to accept at least one butt hinge in such a manner so that the narrow lip and butt hinge combination can support a door panel;

coupling at least one butt hinge to the door panel coupling the butt hinge to the door jamb element so that a portion of the butt hinge is supported by the narrow lip;

placing a transom above the door panel, forming a joint between the transom and the door jamb element;

placing a front batten along the joint; and mating a rear batten to the front batten in such a manner as to fixedly hold the transom.

* * * * *